US005234398A

United States Patent [19]

Larsen

[11] Patent Number: 5,234,398

[45] Date of Patent: Aug. 10, 1993

[54] METHOD AND APPARATUS FOR FOLDING END CLOSURE PANELS

[75] Inventor: Per O. Larsen, Oslo, Norway

[73] Assignee: Elopak Systems AG, Glattbrugg, Switzerland

[21] Appl. No.: 935,981

[22] Filed: Aug. 27, 1992

Related U.S. Application Data

[62] Division of Ser. No. 706,289, May 28, 1991, Pat. No. 5,167,607.

[30] Foreign Application Priority Data

Jun. 2, 1990 [GB] United Kingdom ..... 9012333

[51] Int. Cl.[5] ..... B31B 1/52; B31B 1/54

[52] U.S. Cl. ..... 493/183; 493/184; 493/156; 493/452; 53/370.6

[58] Field of Search ..... 493/156, 157, 165, 166, 493/176, 177, 184, 308, 452, 453, 183; 53/370.6, 372.6, 372.7

[56] References Cited

U.S. PATENT DOCUMENTS

| | | | |
|---|---|---|---|
| 1,931,280 | 10/1933 | Allison | 53/370.6 |
| 3,820,303 | 6/1974 | Martensson | 53/565 |
| 3,999,469 | 12/1976 | Nilsson | 93/36.8 |
| 4,012,997 | 3/1977 | Bachner | 493/183 |
| 4,215,522 | 8/1980 | Clift | 53/378 |
| 4,515,580 | 5/1985 | Lovelace | 493/183 |
| 4,738,077 | 4/1988 | Wakbayashi | 53/375 |

FOREIGN PATENT DOCUMENTS 7525615 3/1975 France .

*Primary Examiner*—Bruce M. Kisliuk
*Assistant Examiner*—Jack Lavinder
*Attorney, Agent, or Firm*—Reising, Ethington, Barnard, Perry & Milton

[57] ABSTRACT

A folding and tucker-tacker station operates upon a flat bottom end closure of a packaging sleeve, which closure comprises first and second panels opposite each other, third and fourth panels opposite each other and between the first and second panels, and a minor panel protruding from the outermost edge of the third panel. The station comprises a mounting supporting first, second and third jaws oscillatable transversely of the sleeve axis for folding inwards the first, second and third panels, and a fourth jaw displaceable along, but not transversely of, the axis for folding inwards the fourth panel. The third jaw has a recess for receiving the minor panel. The fourth jaw is disposed after the third jaw along the path of a mandrel transporting the sleeve

11 Claims, 7 Drawing Sheets

METHOD AND APPARATUS FOR FOLDING END CLOSURE PANELS

This is a division of application Ser. No. 07/706,289, filed on May 28, 1991, now U.S. Pat. No. 5,167,607.

BACKGROUND OF THE INVENTION

1. Field of the Invention

This invention relates to apparatus and method for folding-in end closure portions at an end of a packaging sleeve.

2. Description of Prior Art

Various apparatus and methods of folding-in end closure portions of packaging sleeves are known from, for example, U.S. Pat. Nos. 3,820,303;, 4,337,059, and 4,524,460;, British Patent 1292822; German Patent 687399; Federal German Patent 1952266 and French Patent 7024151.

French Patent 7024151 discloses a system for folding inwards a smaller pair and a larger pair of end closure flaps of a carton. The system includes a compressed-air piston-and-cylinder device which advances, along a supporting rod, an encircling yoke having a smaller pair and a larger pair of arms, the four arms of the yoke being angularly distributed at 90° spacings around the yoke. Mounted diametrically opposite each other upon a ring axially movable along the rod against a spring bias is a first pair of spring-biassed, bell-crank levers, outer free ends of which form a first pair of jaws oscillatable transversely of the axis of the rod. The larger pair of arms acts upon inner free ends of the bell-crank levers to swing the pair of jaws inwards against the spring bias on the levers to fold inwards the smaller end closure flaps. Mounted diametrically opposite each other upon a ring fixed onto the rod is a second pair of spring-biassed, bell-crank levers, outer free ends of which form a second pair of jaws oscillatable transversely of the rod axis. After the larger pair of arms has began to act upon the first pair of bell-crank levers, the smaller pair of arms begins to act upon inner free ends of the second pair of bell-crank levers to swing the second pair of jaws inwards against the spring bias on their levers to fold inwards the larger flaps. Thus, the smaller flaps are folded inwards before the larger flaps. The spring bias on the ring mounting the first pair of levers allows the yoke to advance that ring and the first pair of jaws to remain in their innermost positions while the jaws of the second pair of jaws continue to move towards each other. This system has the disadvantage that the first pair of levers remains in the closure throughout the folding-in of the larger flaps and is thus unsuitable for use in a packaging method in which tucking-tacking of outer subpanels is required.

U.S. Pat. No. 3,820,303 discloses a system in which a mandrel wheel transports carton sleeves anti-clockwise through various treatment stations. In a folding station, score lines of bottom end closure panels of the sleeves are "broken" by turning inwards a pair of jaws in the form of pivotally mounted, triangular wings, to cause them to bear upon respective inner panels of the end closure. The sleeve is then indexed to a heating station in which selected zones of thermoplastics coating of the bottom end closure are heated to soften the thermoplastics. The heated sleeve is then indexed to a sealing station on the path to which is a tucking device by which the prebroken panels of the bottom end closure are folded inwards, with a smaller rectangular outer panel thereof becoming tucked under a larger rectangular outer panel thereof The tucking device includes two folders articulatedly interconnected by a link and turnable, relative to a fixed support plate, about respective axes parallel to the mandrel wheel axis. A first of the two folders is in the form of a U-shaped arm whereof the base of the U is arranged to bear against the smaller outer panel. The second folder is in the form of a bell-crank lever whereof each arm is in the form of a U, the base of the U of one arm being arranged to bear against the larger outer panel and the base of the U of the other arm being attached to a helical tension spring urging this second folder to turn anti-clockwise towards the first folder and thus urging both folders to move oppositely to the advancing bottom end closures In operation, the second folder is struck by the larger outer panel and thus swung clockwise against the spring bias, thereby, through the link, turning the first folder clockwise to cause it to come to bear on the smaller panel. The design and setting of the tucking device are such that the smaller outer panel is to be folded-in just before the larger panel, so that the smaller panel is tucked under the larger panel. However, during their displacement from the folding station to the tucking device by way of the heating station, the panels can move into relative positions which do not lend themselves to accurate folding and tucking by folders bearing upon only the two outer panels, especially since the carton sleeve is actually moving past the tucking device during the folding and tucking. Moreover, correct initial positioning and return of the folders is dependent upon the tension spring, with the consequence that accuracy of positioning and movement of the folders reduces with increased speed of the mandrel wheel and thus increased production rate.

U.S. Pat. No. 4,337,059 discloses a tucker-tacker station for folding-in, tucking and tacking the bottom end closures of pairs of carton sleeves when they have been indexed to the station by a rotary turret including pairs of vertical mandrels. The station includes a pair of vertical, cam-operated, reciprocatory, drive rods each of which drives, via a toggle arrangement, a pair of folding jaws arranged to oscillate transversely of the rod axis. The jaws of this pair swing inwards towards each other, transversely of the path of the mandrel pairs, to bear upon and thereby fold inwards the inner pair of panels of the bottom end closure and thus begin the inward folding of the two outer panels of the end closure. Each rod also drives, via a horizontal end plate fixed thereto, a pair of tucker-tacker jaws pivotally mounted upon brackets fixed to the end plate so as to oscillate transversely of the rod axis. The jaws of this pair swing inwards, along a tangent to the mandrel path, to bear on and thus fold inwards the respective panels of the outer pair and thereby to continue the inward folding of the inner pair of panels, one of the latter pair of jaws causing one of the outer pair of panels to lead the other of the outer pair in its inward turning, so that the one becomes tucked beneath the other. At the ends of their inward swings, the tucker-tacker jaws press the panels against the end face of a water-cooled cap of the mandrel to tack them together prior to pressure-sealing at a subsequent bottom sealing station. Because the toggle arrangement passes through dead centre during the lowering of the vertical drive rods and again during the raising of the rods, the pair of folding jaws is moved inwardly and outwardly twice during one bottom end closing operation, with the first inward movement of the folding jaws producing the folding of the inner pair of panels and the second inward movement being superfluous. During the upward movement of the end plate, the tucker-tacker jaws come to bear on the outer pair of panels to fold them inwards, tuck one beneath the other and tack them together. The vertical rods are moved downwards to lower the end plates and then the carton sleeves with tacked bottom end closures are stepped to the pressure-sealing station. This known assembly is relatively complex, with four pivotally mounted jaws.

SUMMARY OF THE INVENTION

According to a first aspect of the present invention, there is provided folding apparatus for folding-in end closure portions at an end of a packaging sleeve, comprising supporting means, first and second jaws oscillatable, relative to said supporting means, in a sense transverse to a longitudinal axis of said sleeve for bearing respectively upon first and second diametrically opposite portions of said end closure portions to fold the first and second portions inwards, a third jaw oscillatable, relative to said supporting means, transversely of said sense and said axis for bearing upon a third portion of said end closure portions intermediate said first and second portions to fold said third portion inwards, and a fourth jaw fixed relative to said supporting means and arranged to co-operate with said third jaw and to bear upon a fourth portion of said end closure portions According to a second aspect of the present invention, there is provided a method of folding-in end closure portions at an end of a packaging sleeve, comprising producing relative displacement between first and second jaws and between said jaws and said sleeve in a first sense transverse to a longitudinal axis of said sleeve to cause said first and second jaws to bear respectively upon first and second diametrically opposite portions of said end closure portions to fold the first and second portions inwards, producing relative displacement between a third jaw and said sleeve in a second sense transversely of said first sense and said axis to cause said third jaw to bear upon a third portion of said end closure portions intermediate said first and second portions and thereby to fold said third portion inwards, and producing, between said sleeve and a fourth jaw, relative displacement having substantially no component transverse to said axis, to cause said fourth jaw to bear upon a fourth portion of said end closure portions According to a third aspect of the present invention, there is provided packaging apparatus comprising a folding station for folding-in first and second end closure portions at an end of a packaging sleeve, said folding station comprising supporting means, a first jaw fixed relative to said supporting means and arranged to bear upon the first end closure portion to fold the same inwards onto the second end closure portion, and a second jaw oscillatable, relative to said supporting means, transversely of a longitudinal axis of said sleeve, for bearing upon the second end closure portion to tuck the same beneath said first end closure portion, and a mandrel movable along a path relative to said supporting means for receiving said sleeve therearound and for carrying said sleeve past said supporting means, said first jaw being arranged after said second jaw in the direction of movement of said mandrel and being outside said path in a condition in which said first jaw presses said first end closure portion onto said second end closure portion.

According to a fourth aspect of the present invention, there is provided a method comprising causing a mandrel to receive a packaging sleeve therearound, producing relative displacement between said mandrel and supporting means at a folding station, causing a first jaw fixed relative to said supporting means to bear upon a first end closure portion of an end of a packaging sleeve to fold said first end closure portion inwards onto a second end closure portion of said end of said packaging sleeve, producing relative displacement between a second jaw and said sleeve and between said second jaw and said supporting means, transversely of a longitudinal axis of said sleeve, to cause said second jaw to bear upon said second end closure portion to tuck the same beneath said first end closure portion, and advancing said mandrel past said first jaw, which is arranged after said second jaw in the direction of advance of said mandrel, while said first jaw presses said first end closure portion onto said second end closure portion.

Such arrangement of a jaw fixed relative to the supporting means has the advantage of simplifying the apparatus. Moreover, such advance of the end closure across the fixed jaw has the advantage of giving accurate control of the folding-in of the outermost end closure portion.

According to a fifth aspect of the present invention, there is provided folding apparatus for folding-in first and second end closure panels arranged opposite to each other at an end of a packaging sleeve whereof a longitudinally outermost edge zone of the first panel is shorter than a longitudinally outermost edge zone of the second panel and becomes folded back outwardly relative to the remainder of the first panel, comprising a jaw oscillatable relative to the sleeve, transversely of the longitudinal axis of the sleeve, for bearing upon the first panel to fold the same inwards, a recess formed in said jaw along a leading edge zone of said jaw and at least as long as said edge zone of the first panel for extending transversely of said longitudinal axis and for receiving said end zone of the first panel during folding thereof thereby, and means displaceable, relatively to said sleeve, to bear upon the second panel to fold the same inwards.

According to a sixth aspect of the present invention, there is provided a method of folding-in first and second end closure panels arranged opposite to each other at an end of a packaging sleeve whereof a longitudinally outermost edge zone of the first panel is shorter than a longitudinally outermost edge zone of the second panel, comprising producing relative displacement between a jaw and the sleeve transversely of the longitudinal axis of the sleeve to cause the jaw to bear upon the first panel to fold the same inwards to cause said edge zone of the first panel to be received in a recess in said jaw, and producing relative displacement between means and said sleeve to cause said means to bear upon the second panel to fold the same inwards, said edge zone of the first panel becoming folded back outwardly relative to the remainder of the first panel.

Such provision of a recess in the jaw has the advantage of improving the tucking-in of the first panel under the second panel and also the folding-back of that edge zone of the first panel.

BRIEF DESCRIPTION OF THE DRAWINGS

In order that the invention may be clearly understood and readily carried into effect, reference will now be made, by way of example, to the accompanying drawings, in which:

FIG. 2 shows a perspective view of a bottom closure zone of a carton sleeve made from the blank of FIG. 1, with end closure panels thereof partially folded-in.

DESCRIPTION OF THE PREFERRED EMBODIMENT

Figure 1:
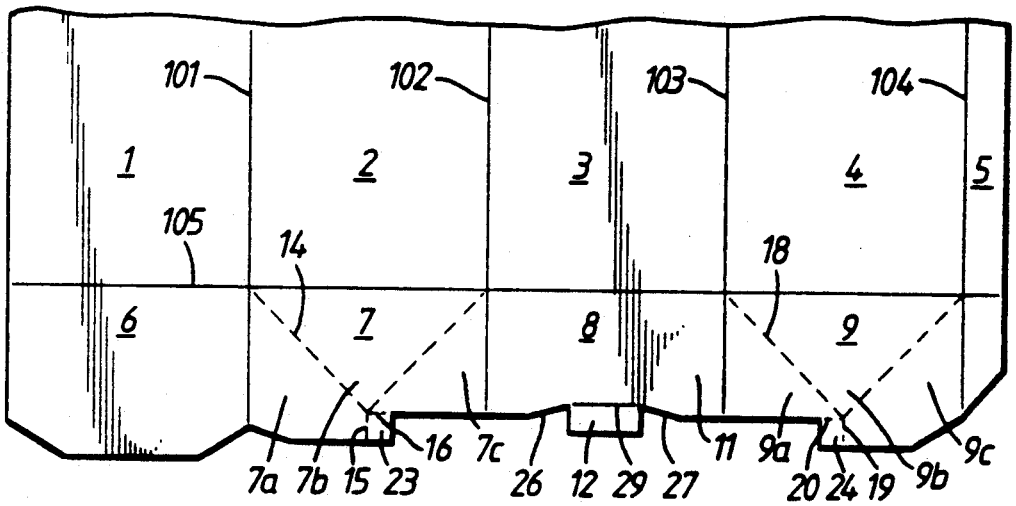
FIG. 1 is a fragmentary plan view of a bottom closure zone of a blank from which a carton is to be made.
Figure 2:
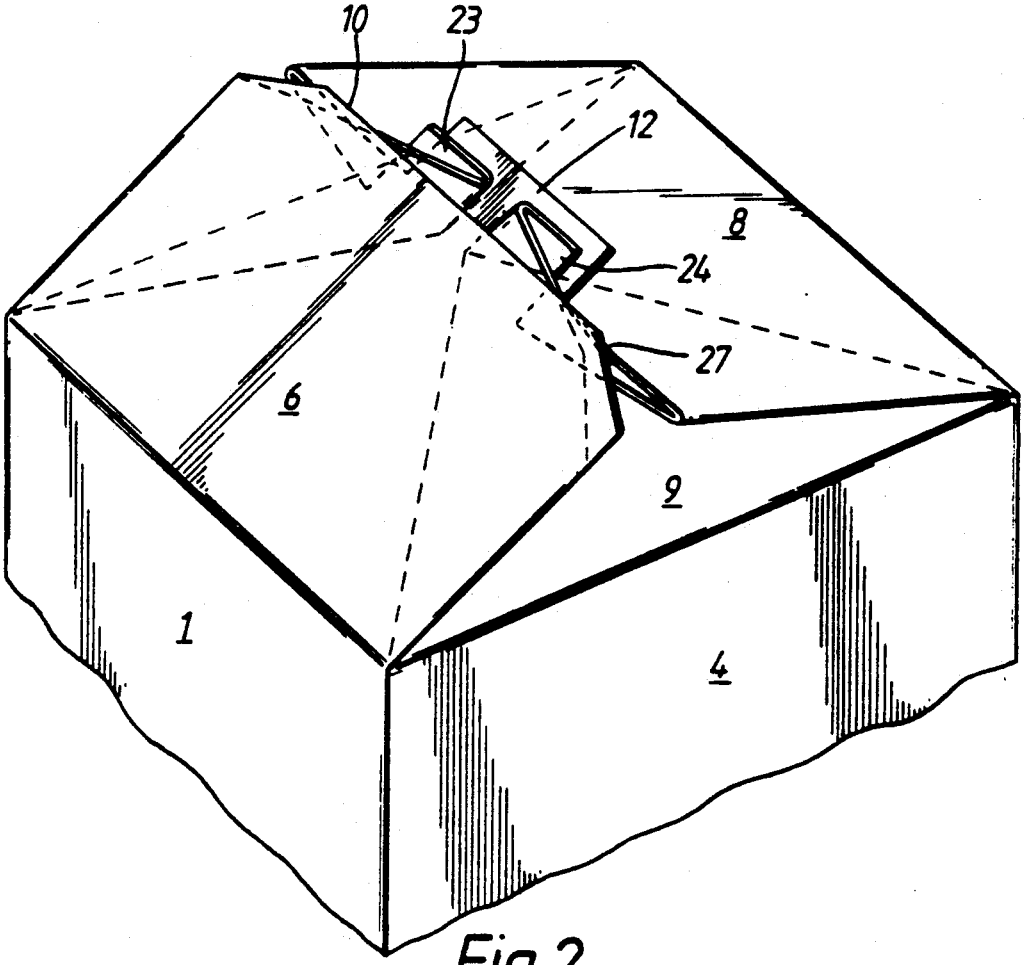
Figure 3:
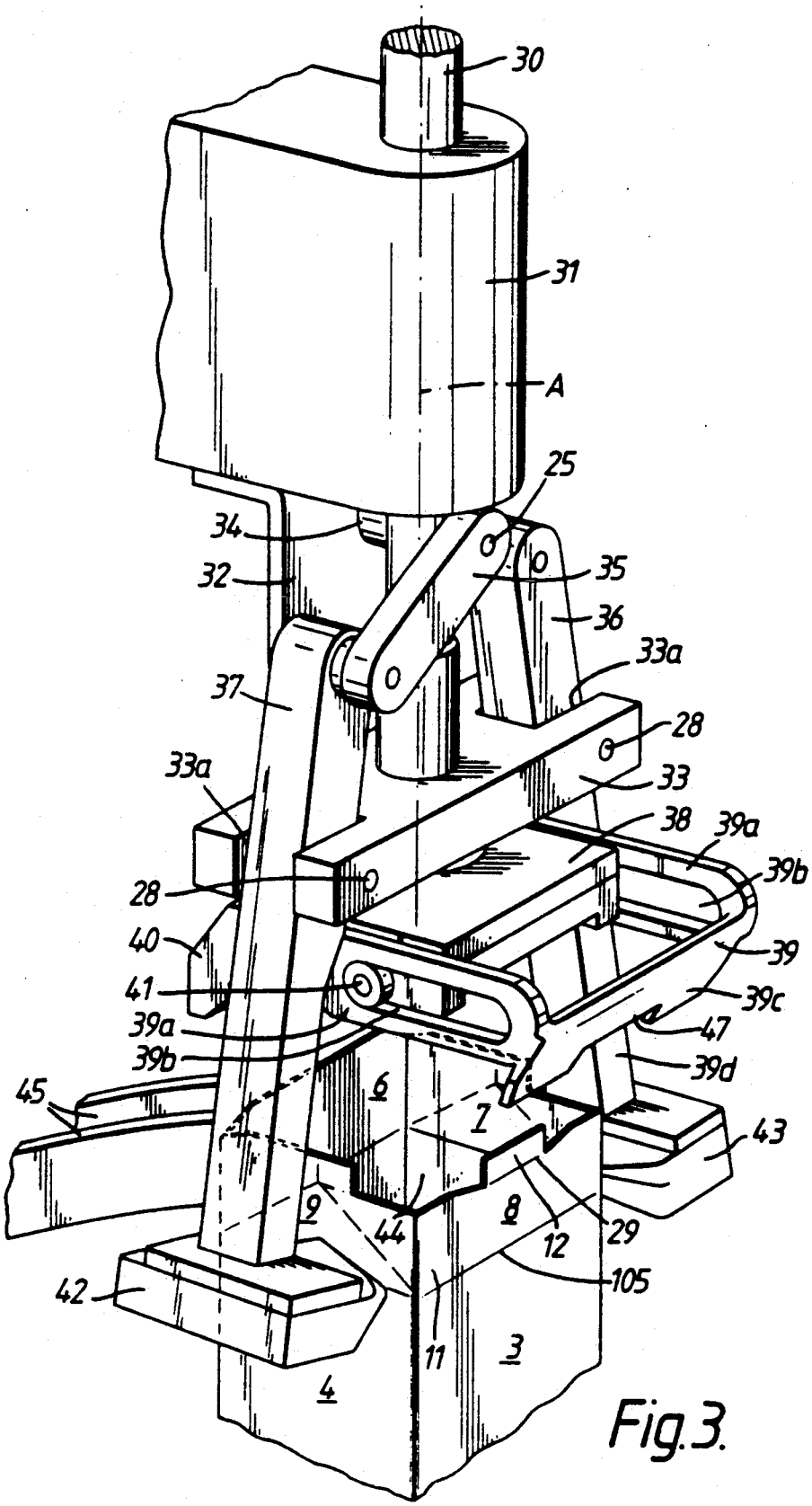
FIG. 3 is a fragmentary perspective view of a bottom end closure folding and tucker-tacker station of a packaging machine.

Referring to FIG. 1, the blank comprises four side panels, 1 to 4, and four end closure panels, 6 to 9, with a narrow sealing seam panel 5. The panels 1 to 9 are defined by score lines 101 to 105. Oblique score lines 14 and oblique score lines 18, together with short score lines 15 and 19 parallel to the score lines 101 to 104, and also short score lines 16 and 20 parallel to the score line 105, divide the respective panels 7 and 9 into substantially triangular sub-panels 7*a*, 7*b*, and 7*c*, and 9*a*, 9*b*, and 9*c*, and small rectangular sub-panels 23 and 24, respectively. A score line 29 parallel to the score line 105 divides the panel 8 into a major, substantially rectangular, sub-panel 11 and a minor, substantially rectangular, sub-panel 12 protruding from the sub-panel 11 and bounded by respective cut-away notches 26 and 27.

Figure 4A:
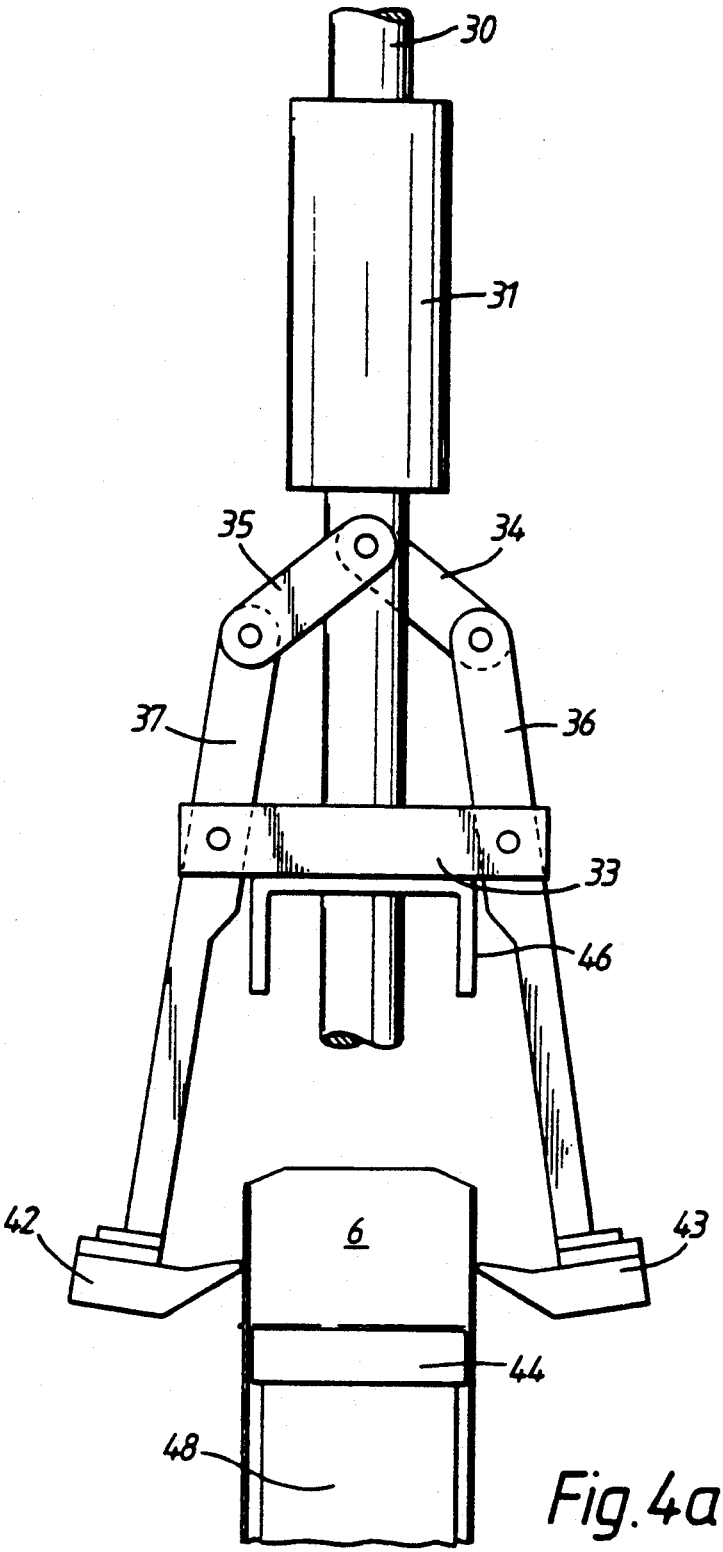
FIG. 4*a* shows a fragmentary front view of the station prior to the folding and tucking action.
Figure 4B:
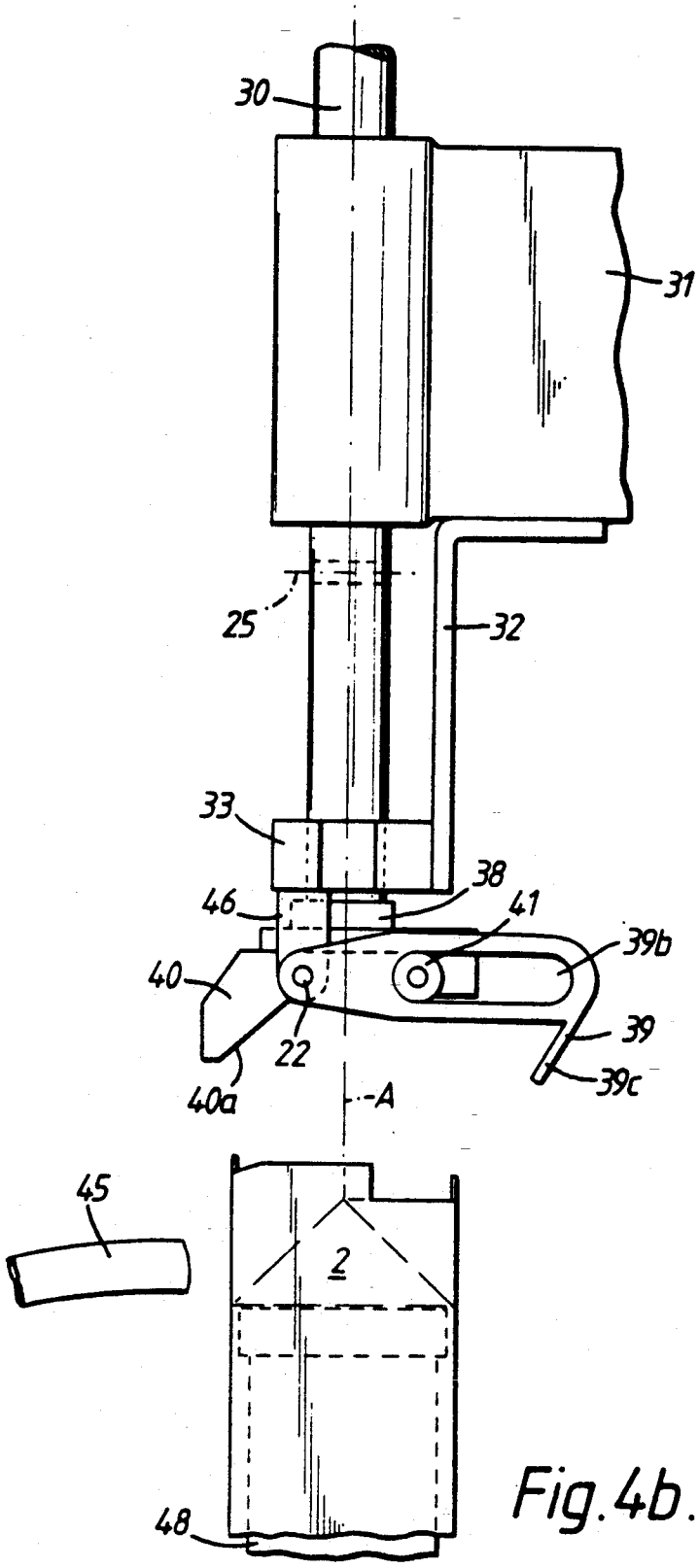
FIG. 4*b* is a fragmentary side view of the station prior to that action.
Figure 5:
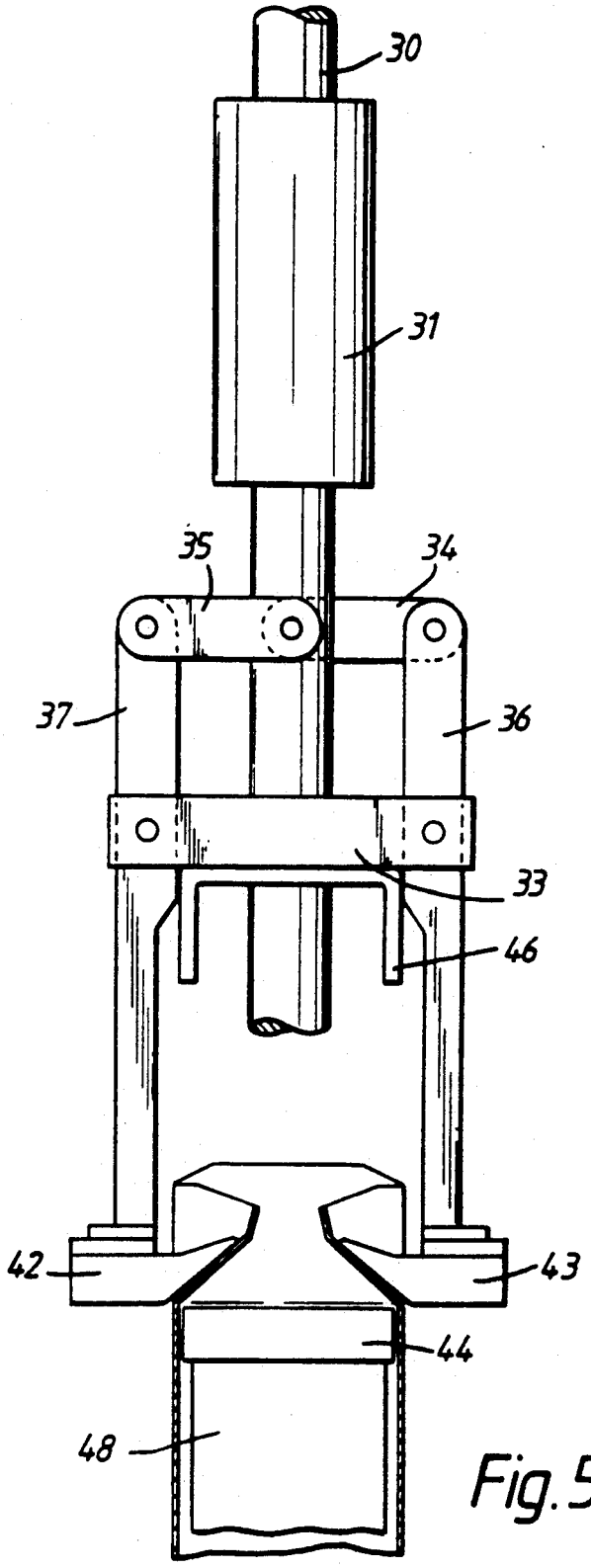
FIG. 5 is a view similar to FIG. 4*a*, but with the station seen in a condition during that action.

To form a carton sleeve from the blank of FIG. 1, the panels 1 to 9 are folded about the score lines 101 to 104 and the panel 5 is heat-and pressure-sealed to the panels 1 and 6. The carton sleeve thereby formed is fed over a rectangular-section, free end cap 44 of a mandrel 48 (see FIG. 4*a*) until the score line 105 is at the level of the radially outermost surface of the end cap 44. The mandrel is then indexed through a bottom closure heating station to a folding and tucker-tacker station shown in FIGS. 3 to 6.

Figure 6A:
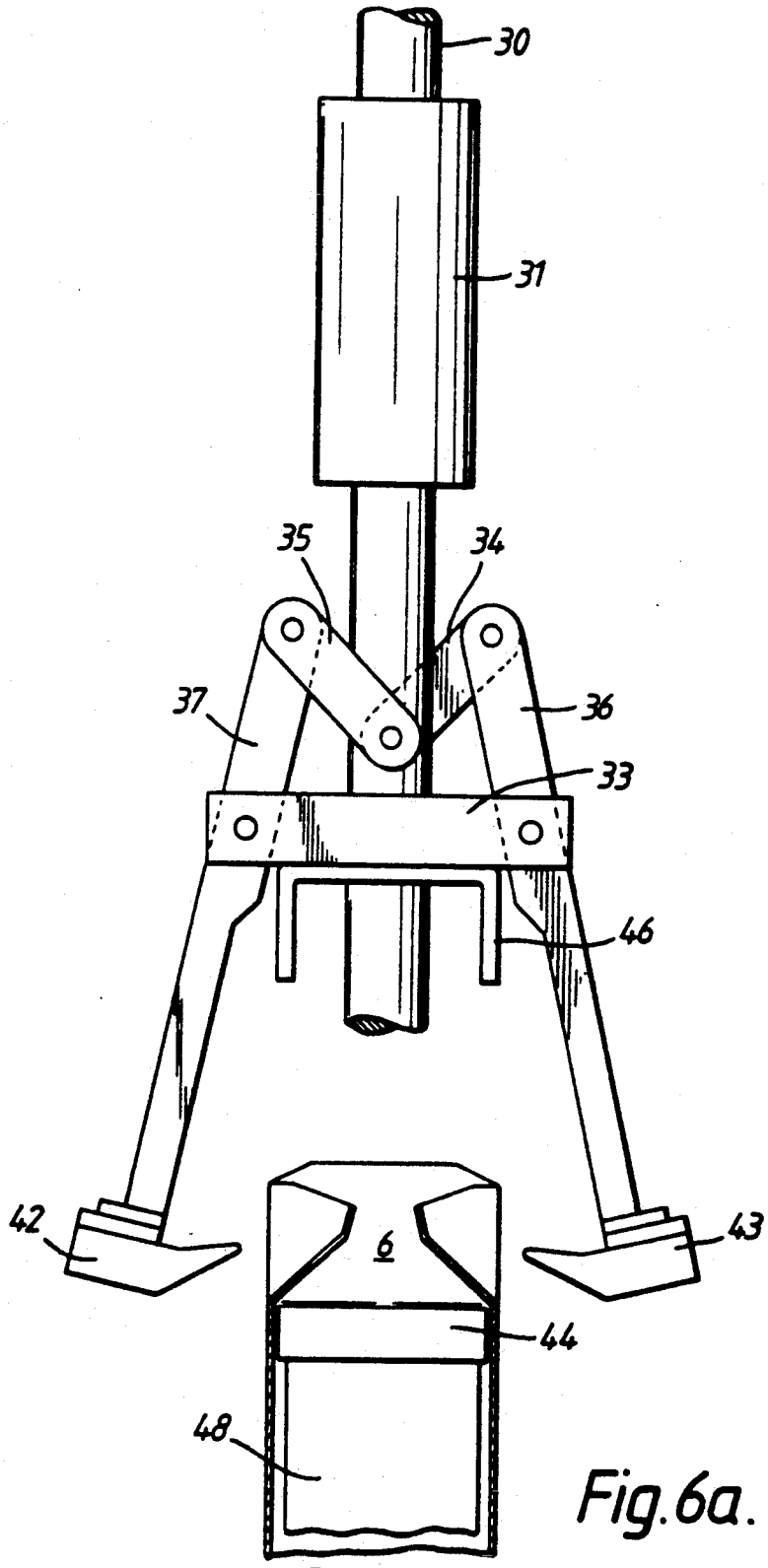
FIG. 6*a* is a view similar to FIG. 4*a*, but with the station in a condition approaching the end of that action.
Figure 6B:
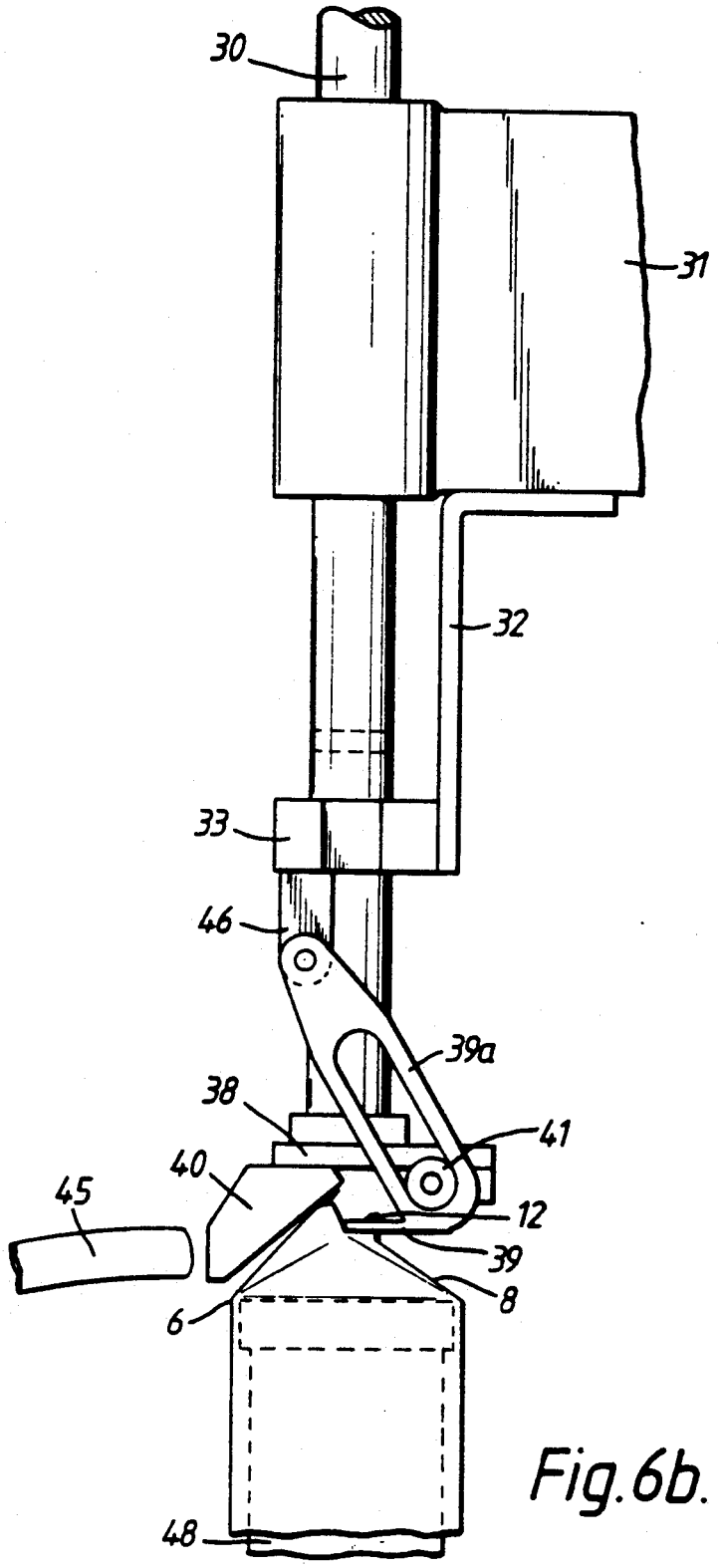
FIG. 6*b* is a view similar to FIG. 4*b*, but with the station in the condition of FIG. 6*a*.

The folding and tucker-tacker station comprises a fixed mounting 31 through which extends, co-axially with the stationary mandrel 48, a reciprocatory plunger 30 extending inwards through a guide bore through a yoke 33 fixed to the mounting 31 by way of a bracket 32. Fixed to the innermost end of the plunger 30 is a tacker jaw 40 having an inner face 40*a* obliquely inclined to the axis A of the plunger 30 and the stationary mandrel 48. The yoke 33 extends parallelly to the axis of rotation of the mandrel 48 and has rectangular recesses 33*a* formed in its respective end zones. Extending perpendicularly to the yoke 33 and to the axis A are respective pivots 28 which bridge the respective recesses 33*a* and mount respective panel-folding levers 36 and 37. The innermost ends of the levers 36 and 37 carry respective panel-folding jaws 42 and 43, whilst the respective outermost ends of the levers 36 and 37 are articulated by way of respective links 34 and 35 with a common pivot 25 extending transversely through the plunger 30 parallelly to the pivots 28. A toggle mechanism is thereby formed so that, upon the plunger 30 being displaced inwards from the position shown in FIG. 3, the panel-folding jaws 42 and 43 are turned inwards to come to bear against the panels 7 and 9 and not only fold them inwards about the score line 105 but also pull inwards and thus fold inwards about the score line 105 the panels 6 and 8 until, in the condition shown in FIG. 5, the links 34 and 35 are coaxial with each other and the jaws 42 and 43 have reached their positions of maximum folding of the panels 7 and 9. Continued inwards movement of the plunger 30 then begins to swing the jaws 42 and 43 away from the folded-in panels 7 and 9, until the condition shown in FIG. 6*a* is reached, in which the jaws 42 and 43 are clear of the indexing path of the carton sleeve. Fixed to the yoke 33 and extending inwards therefrom are a pair of brackets 46 which, in the condition shown in FIG. 3 and 4*b*, embrace a tucker plate 38 and the tacker jaw 40. Embracing the plate 38 is a roughly U-shaped tucker 39 whereof the lateral limbs 39*a* are formed with respective slots 39*b* whereby the tucker 39 is guided upon respective rollers 41 mounted firmly upon the tucker plate 38. A plate-form tucker jaw 39*c* interconnects the limbs 39*a* and projects therefrom towards the stationary mandrel 48. Extending along the leading edge zone of the jaw 39*c* is a recess 39*d* of a length slightly greater than that of the sub-panel 12. At those ends of the limbs 39*a* furthest from the jaw 39*c*, the limbs 39*a* are connected to the free ends of the brackets 46 by pivots 22. As the plunger 30 begins its inward travel, the tucket plate 38 lowers the jaw 40 and the rollers 41, so causing the tucker 39 to begin to swing inwards about the pivots 22. As the jaws 42 and 43 withdraw from their positions shown in FIG. 5, the oblique face 40*a* of the jaw 40 and the tucker jaw 39*c* come to bear upon the panels 6 and 8. The pressing of the outermost edge zones of the panels 6, 7 and 9 against the sub-panel 12 causes the latter to fold outwardly about score line 29, the sub-panel 12 being received in the recess 39*d* and being folded back upon that portion 47 of the plate 39*c* bridging the recess 39*d*. With the plunger 30 in its innermost position shown in FIGS. 6*a* and 6*b*, the mandrel 48 can now be indexed forward, so that the panel 6 and then the panel 8 slide beneath the tacker jaw 40 to immediately beneath guide rails 45 which extend to the bottom closure pressure-sealing station and which maintain the bottom end closure well folded-in ready for sealing. The plunger 30 is then immediately returned to the condition shown in FIG. 3.

The apparatus and method described with reference to the drawings have a number of advantages. Firstly, the folding-in longitudinally of the axis of rotation of the mandrel 48 and the folding-in transversely of that axis, with tucking-in and tacking, are performed at one and the same station. The use of a single reciprocatory plunger to achieve the actions not only simplifies the drive mechanism but also avoids any sychronization problems. Moreover, the use of a tacking jaw 40 fixed relative to the plunger 30, with a moving tucking jaw 39 movable relative to the plunger 30, provides a relatively simple tucking and tacking mechanism. Furthermore, the provision of the recess 39*d* ensures that not only is the sub-panel 11 well tucked-in beneath the panel 6, but also the sub-panel 12 is appropriately folded back outwards upon the sub-panel 11.

I claim:

1. Packaging apparatus comprising a folding station for folding-in first and second end closure portions at an end of a packaging sleeve, said folding station comprising supporting means, a first jaw fixed against displacement relative to said supporting means and arranged to bear upon the first and closure portion to fold said first end closure portion inwards onto the second end closure portion, and a second jaw oscillatable, relative to said supporting means, transversely of a longitudinal axis of said sleeve at said folding station, for bearing upon the second end closure portion to tuck said second end closure portion beneath said first and closure portion, and a mandrel movable along a path relative to said supporting means for receiving said sleeve therearound and for carrying said sleeve past said supporting means, said first jaw being arranged after said second jaw in the direction of movement of said mandrel and being outside said path in a condition of said first jaw in which said first jaw presses said first end closure portion onto said second end closure portion.

2. Packaging apparatus according to claim 1, wherein said first jaw has a face obliquely inclined to said axis for bearing upon said first end closure portion.

3. Packaging apparatus according to claim 1, wherein said supporting means comprises a plunger extending along and reciprocable along said axis, and said first jaw is fixedly mounted on an end of said plunger.

4. Packaging apparatus according to claim 1, and further comprising mounting means, said supporting means and said mounting means being relatively displaceable, and camming means connected between said supporting means and said mounting means and connected to said second jaw, and effective to produce the oscillation of said second jaw upon relative displacement of said supporting means and said mounting means.

5. Packaging apparatus according to claim 1, wherein said second jaw has a recess formed therein for receiving a relatively short, longitudinally outermost, edge zone of said second end closure portion.

6. A method comprising causing a mandrel to receive a packaging sleeve therearound, producing relative displacement between said mandrel and supporting means at a folding station, causing a first jaw fixed against displacement relative to said supporting means to bear upon a first end closure portion of an end of a packaging sleeve to fold said first end closure portion inwards onto a second end closure portion of said end of said packaging sleeve, producing relative displacement between a second jaw and said sleeve and between said second jaw and said supporting means, transversely of a longitudinal axis of said sleeve at said folding station, to cause said second jaw to bear upon said second end closure portion to tuck said second end closure portion beneath said first end closure portion, and advancing said mandrel past said first jaw, which is arranged after said second jaw in the direction of advance of said mandrel, while said first jaw presses said first end closure portion onto said second end closure portion.

7. A method according to claim 6, wherein relative displacement is produced between mounting means and said supporting means to cause camming means connected between said supporting means and said mounting means to produce said relative displacement between said second jaw and said sleeve.

8. A method according to claim 6, wherein said relative displacement between said second jaw and said sleeve not only causes said second jaw to bear upon said second end closure portion to fold said second end closure portion inwards, but also causes a relatively short, longitudinally outermost, edge zone of said second end closure portion to be received in a recess in said second jaw, said edge zone of said second end closure portion becoming folded back outwardly relative to the remainder of said second end closure portion.

9. Folding apparatus for folding-in first and second end closure panels arranged opposite to each other at an end of a packaging sleeve whereof a longitudinally outermost edge zone of the first panel is shorter than a longitudinally outermost edge zone of the second panel and becomes folded back outwardly relative to the remainder of the first panel, comprising a jaw oscillatable relative to the sleeve, transversely of the longitudinal axis of the sleeve, for bearing upon the first panel to fold said first panel inwards, a recess formed in said jaw along a leading edge zone of said jaw and at least as long as said edge zone of the first panel for extending transversely of said longitudinal axis and for receiving said edge zone of the first panel during folding of said first panel by said jaw, and means displaceable, relatively to said sleeve, to bear upon the second panel to fold said second panel inwards.

10. Folding apparatus according to claim 9, and further comprising mounting means and supporting means displaceable relatively to each other, and camming means connected between said supporting means and said mounting means, connected to said jaw, and effective to produce the oscillation of said jaw upon relative displacement of said supporting means and said mounting means.

11. A method of folding-in first and second end closure panels arranged opposite to each other at an end of a packaging sleeve whereof a longitudinally outermost edge zone of the first panel is shorter than a longitudinally outermost edge zone of the second panel, comprising producing relative displacement between a jaw and the sleeve transversely of the longitudinal axis of the sleeve to cause the jaw to bear upon the first panel to fold said first panel inwards to cause said edge zone of the first panel to be received in a recess in said jaw, and producing relative displacement between folding means and said sleeve to cause said folding means to bear upon the second panel to fold the same inwards while causing said edge zone of the first panel to be folded back outwardly relative to the remainder of the first panel.

* * * * *